US010767328B2

(12) United States Patent
Renshaw

(10) Patent No.: US 10,767,328 B2
(45) Date of Patent: Sep. 8, 2020

(54) DOCK WALER

(71) Applicant: Pultron Composites Limited, Gisborne (NZ)

(72) Inventor: Peter Louis Renshaw, Gisborne (NZ)

(73) Assignee: Pultron Composites Limited, Gisborne (NZ)

( * ) Notice: Subject to any disclaimer, the term of this patent is extended or adjusted under 35 U.S.C. 154(b) by 0 days.

(21) Appl. No.: 16/302,342

(22) PCT Filed: May 17, 2017

(86) PCT No.: PCT/NZ2017/050062
§ 371 (c)(1),
(2) Date: Nov. 16, 2018

(87) PCT Pub. No.: WO2017/200393
PCT Pub. Date: Nov. 23, 2017

(65) Prior Publication Data

US 2019/0211520 A1 Jul. 11, 2019

(30) Foreign Application Priority Data

May 19, 2016 (NZ) ..... 720363

(51) Int. Cl.
*B63B 35/38* (2006.01)
*E02B 3/06* (2006.01)
*B63B 59/02* (2006.01)

(52) U.S. Cl.
CPC ..... *E02B 3/064* (2013.01); *B63B 35/38* (2013.01); *B63B 59/02* (2013.01)

(58) Field of Classification Search
CPC ..... B63B 35/38; B63B 59/02; F02B 3/064; E02B 3/064
See application file for complete search history.

(56) References Cited

U.S. PATENT DOCUMENTS 4,010,716 A * 3/1977 Minka ..... F01C 1/077 123/245
5,333,557 A 8/1994 Eickoff
2010/0294190 A1 11/2010 Kor et al.
2014/0007803 A1* 1/2014 Moody ..... B63B 3/08 114/263
2014/0110491 A1* 4/2014 Roberts, Jr. ..... B29C 49/04 238/84
2014/0182505 A1 7/2014 Imel et al.
2016/0010724 A1* 1/2016 Bakker ..... F16B 33/006 403/48

FOREIGN PATENT DOCUMENTS

AU 2014204501 A1 2/2015

* cited by examiner

*Primary Examiner* — Stephen P Avila
(74) *Attorney, Agent, or Firm* — Gable Gotwals

(57) ABSTRACT

The invention provides a dock waler moulded from a settable material, where the dock waler defines a main body which encloses a volume and defines at least one interior cavity. The main body also defines at least one engagement structure arranged to engage with a complimentary engagement structure formed in a dock float assembly.

18 Claims, 6 Drawing Sheets

DETAIL E

DOCK WALER

CROSS-REFERENCE TO RELATED APPLICATIONS

This United States application is the National Phase of PCT Application No. PCT/NZ2017/050062 filed 17 May 2017, which claims priority to New Zealand Patent Application No. 720363 filed 19 May 2016, each of which is incorporated herein by reference.

FIELD OF THE INVENTION

This invention relates to an improved dock waler which is moulded from a settable material. Preferably the waler provided by the invention defines one or more features adapted to connect to the perimeter side edge of a dock float assembly.

BACKGROUND OF THE INVENTION

Floating docks are formed from a number of components which need to be fitted together securely. In particular it is common to find floating docks fitted with a timber waler or whaler beam running along the side of a series of float units and flush with an upper deck surface. These walers are commonly connected to the other components of the floating dock with a tie rod or bolt, where the same rod can also be used to lock together additional components of the dock. A representative example of modular floating dock units connected together by waler beams is disclosed in U.S. Pat. No. 2,857,872.

Floating dock assemblies are constantly exposed to water, and commonly salt water, which can degrade connection elements over time. Wave and wake action also rocks and bends the dock structure frequently—fatiguing and potentially resulting in the failure of the rigid elements used to assemble the dock.

Walers used in these applications are commonly formed by long wooden timbers. However the use of wooden materials in these applications does present some additional problems.

The aquatic environment in which whalers are deployed means that either rare expensive hardwoods need to be used, or alternatively chemically treated timbers must be employed. Both of these options have environmental impacts with the consumption of non-sustainably grown hardwood timbers or the leaching of treatment chemicals into the surrounding environment.

Timber walers also have a limited lifespan due to the constant motion induced by wave action, and periodic shrinkage and expansion due to immersion in water. Eventually the timbers employed to lock together multiple float units will fatigue and will ultimately fail. The strength requirements of timber walers therefore dictate the use of large heavy wooden beams, which in turn increases the buoyancy requirements of the associated floating dock assembly. In various applications the strength of the timber waler used needs to be over engineered to allow for inconsistencies in the strength of timber sourced from different trees.

Some design compromises are also introduced in floating dock assemblies which use timber whalers. The maximum length of a timber waler is restricted by the height of the trees available to produce the timber required. Therefore it may not be possible to construct a floating dock structure of a desired length which has float units connected together by a single timber waler.

It would be of advantage to have improvements over the prior art which addressed the above issues or at least provided the public with an alternative choice. In particular, it would be of advantage to have improvements in respect of dock walers which are moulded from settable materials and which also define features which at least assist in the connection of the waler to additional components of the dock structure.

DISCLOSURE OF THE INVENTION

According to one aspect of the present invention there is provided a dock waler moulded from a settable material, the dock waler defining a main body which encloses a volume and defines at least one interior cavity, the body defining at least one engagement structure arranged to engage with a complimentary engagement structure formed in a dock float assembly.

Preferably the dock waler defines a longitudinal axis, wherein said at least one engagement structure runs parallel to this axis but does not extend to the longitudinal ends of the dock waler.

Preferably the dock waler defines a flex control structure at a longitudinal end of the dock waler, said flex control structure being arranged to contact a complimentary flex control structure formed in a dock float assembly when the end or ends of the dock waler flex out of alignment with the longitudinal axis of the dock waler.

Preferably the dock waler defines a flex control structure at each longitudinal end of the dock waler.

According to a further aspect of the present invention there is provided a dock waler substantially as described above wherein the main body defines at least two access ports configured to locate at least one service conduit run through the interior cavity of the main body.

According to yet another aspect of the present invention there is provided a floating dock which includes at least one dock waler substantially as described above, and a plurality of dock float assemblies each defining a complimentary engagement structure, the plurality of dock float assemblies being engaged together by the engagement structure of at least one dock waler contacting the complimentary engagement structures of the dock float assemblies.

According to yet another aspect of the present invention there is provided a floating dock substantially as described above which includes at least one tie rod connected to each dock float assembly, said tie rods being configured to engage with a dock waler to connect the dock waler to said dock float assemblies.

Preferably said at least one tie rod holds the engagement structure of a dock waler in contact with the complimentary engagement structure of a dock float assembly.

Preferably said at least one engagement structure of a dock waler defines at least one angled contact surface arranged to contact a complimentary angled contact surface formed in a complimentary engagement structure, said angled contact surfaces being orientated at an angle to a vertical plane when integrated into a floating dock.

The present invention relates to improvements in respect of dock whalers and in the assembly of floating docks. The invention therefore resides in the provision of a dock waler, in addition to a floating dock constructed using this form of dock waler. Reference in general throughout this specification will be made to the invention providing or being resident in a dock waler, while those skilled in the art will appreciate that the above should in no way be seen as limiting.

The dock waler provided by the invention facilitates the construction of a floating dock assembly, with a waler connecting together of a number of dock float assemblies. A dock waler provided by the invention may be engaged with the perimeter sides of two or potentially more dock floats to connect these elements together, while also providing impact protection to vessels using the resulting floating dock. Such a dock waler therefore forms a relatively long and comparatively thin beam, the length of this beam defining a longitudinal axis for the waler with the two ends of the beam forming longitudinal ends of the waler. One side of the waler beam then engages with a number of dock float assemblies with the opposite side facing the water.

A dock waler provided by the invention is preferably moulded entirely from a settable material. Suitable settable materials such as hydrocarbon based plastics or resins may be moulded to provide an inexpensive light weight and strong dock waler which is resistant to effects of the aquatic environment which it is exposed to.

In various embodiments a dock waler provided by the invention may be moulded from a wide range of materials.

In some embodiments the settable material is formed from or incorporates fibre reinforced plastics.

In some embodiments the settable material is formed from or incorporates a thermosetting resin. Common thermosetting resins could include—but are not limited to—isopthalic polyester, orthopthalic polyester, vinylester, epoxy, and/or polyurethane.

In some embodiments the settable material is formed from or incorporates a thermoplastic resin. For example, in various thermoplastic resins which could also be used in a fibre reinforced plastic dock waler in a number of embodiments. For example, nylon, polyethylene and polypropylenes could be used in such applications.

In some embodiments the settable material is formed from or incorporates a thermoplastic.

Those skilled in the art will also appreciate that a mixture of such materials as referenced above may also be used in some embodiments to form a dock waler.

Fibre reinforcement can be provided in various embodiments by glass fibre, but could also include basalt, aramid and carbon fibres. Furthermore there is also the possibility in some embodiments of mixed fibres being used—for example only, mixtures of glass and carbon, or aramid and carbon could be used. In various embodiments a dock waler may be formed with non-glass reinforced plastics—in some embodiments being thermoplastics such as polyethylene, polypropylene, nylon, and/or PVC. In yet other embodiment wood-filled plastics may also be employed.

A dock waler provided by the invention incorporates a main body which encloses a volume of space and defines at least one interior cavity. In a further preferred embodiment this main body may define a single interior cavity, providing a hollow lightweight and economic dock waler. Furthermore, in various embodiments this waler may incorporate one or more internal strengthening ribs which span this interior cavity.

In preferred embodiments the main body of a dock waler may define two or more access ports. These access ports can be used to receive one or more service conduits which allow for the transport of resources or the provision of services along the resulting floating dock. For example, in some embodiments at least one service conduit provides any one or combination of fresh water, hydrocarbon based fuels, electrical energy supply currents and/or form one or more communications cables. The routing of service conduits through the interior cavities of dock whalers provides a protective environment for each service conduit, while also locating these conduits in areas which can be accessed easily relatively easily for repair and maintenance work.

A body main body provided by a dock waler also defines a least one engagement structure which is used to engage the waler with a complimentary engagement structure formed on or in a dock float assembly. The form or shape of these engagement structures and their complimentary opposites are defined so as to interlock with one another, with a void in one structure being filled by a projection provided by another.

For example, in one possible embodiment an engagement structure may be formed from a triangular form projection which is received by a matching slot defining a complimentary engagement structure. Those skilled in the art will appreciate that a range of different engagement structures may be employed by the present invention to connect together various components of a dock assembly.

In preferred embodiments tie rods or bolts may be employed to lock or connect together the dock whaler and associated float assemblies. In such embodiments a tie rod can project through the side edge of a float assembly and through the side of a dock waler to hold the engagement structure of the dock waler in contact with the complimentary engagement structure of a dock float assembly. In this way the tie rod holds the engagement structure of a dock waler in contact with the complimentary engagement structure of a dock float assembly.

In a preferred embodiment an engagement structure and its compliment may be connected together by a laterally or horizontally sliding the dock waler along the perimeter side of a float assembly. This arrangement of the invention greatly simplifies the construction process for the resulting floating dock in addition to reinforcing the connections provided between a float assembly and dock waler.

In a preferred embodiment an engagement structure of a dock waler defines at least one angled contact surface arranged to contact a complimentary angled contact surface formed in a complimentary engagement structure. When the waler and float are connected together to form a dock these angled contact surfaces are orientated at an offset angle to a vertical plane.

This angling of contact surfaces reduces the vertical loads applied to these tie rods, thereby reducing the strength requirements for these components or mitigating fatigue loads experienced by same. The intermittent vertical loads placed on the waler by water movements are translated by these angled contact surfaces into horizontal tensioning forces applied to the tie rods.

In a preferred embodiment a dock waler's engagement structure can run parallel to the longitudinal axis of the waler but may not extend to the longitudinal ends of the dock waler.

In a further preferred embodiment the dock waler can define a flex control structure in at least one of its longitudinal ends. This flex control structure can be arranged to contact a complimentary flex control structure formed in a dock float assembly when the end or ends of the dock waler flex vertically out of alignment with the longitudinal axis of the dock waler.

For example, in embodiments where an engagement structure projects from the main body of the waler, this projecting structure may start to taper in height as it extends towards the end of the waler to form a flex control structure.

The tapered height of the flex control structure formed will therefore move it out of contact with any existing complimentary structures formed in the dock float, and only bring these surfaces back into contact to provide a stop at a maximum allowed degree of vertical flexing of the end of the waler.

Conversely where an engagement structure forms a recess in the main body of the waler, this recess structure may start to flare in height as it extends towards the end of the waler to form a flex control structure. Again this end flaring will provide a stop at the maximum allowed degree of vertical flexing of the end of the waler.

In yet other embodiments the tapering or flaring of such contact surfaces may be implemented within the complimentary structures of a floating dock assembly, with the dock waler maintaining a similar form of structure along its length to define the required flex control structures at its ends. For example, in one embodiment a complimentary flex control structure may be formed in a dock float assembly by a recess which can start to flare in height as it extends towards the end of the dock float assembly. In yet further embodiments a dock float assembly may form a complimentary flex control structure which defines a projection which tapers in height as it extends towards the end of the dock float assembly.

The radius of curvature of such tapers or flares in a flex control structure can control the degree of allowable flex of ends of the waler, with a large radius being provided for relatively long flex control structures, and a small radius for short control structures.

The present invention may provide a number of potential advantages over prior art forms of dock whalers.

The invention may provide a dock waler made from a moulded settable material which can replace a traditional wooden waler. In preferred embodiments plastic dock walers may be moulded of any desired length and in a range of colours. The plastic materials used are not susceptible to warping or degradation when immersed in or splashed with salt water for long periods of time. These forms of composite walers are also relatively strong compared with their wooden counterparts and can be formed with hollow internal cavities, reducing the overall weight of the waler which needs to be supported by the floats of the dock.

The hollow internal cavities of the invention's dock walers and the provision of access ports in preferred embodiments allows service conduits to be run through the interior cavities of the walers. These interior cavities provide a protected environment for such service conduits which can also be accessed easily to perform maintenance and repair tasks.

In various embodiments the invention can employ tie rods or nut and bolt assemblies to connect together the engagement structures and their compliments formed in a waler and dock assembly, locking these elements together once correctly aligned and in contact with one another. In preferred embodiments these engagements structures can also define angled contact surfaces to translate vertical loads placed on the waler into tensioning forces applied to the tie rods.

In additional embodiments the invention may also provide for flex control structures in one or both longitudinal ends of a waler, allowing a limited, controlled degree of flexing of the ends of the waler.

BRIEF DESCRIPTION OF THE DRAWINGS

Additional and further aspects of the present invention will be apparent to the reader from the following description of one embodiment, given by way of example only, with reference to the accompanying drawings in which.

DETAILED DESCRIPTION OF THE INVENTION

FIGS. 1 to 9 show a floating dock 1 provided in accordance with a preferred embodiment of the invention. The floating dock includes two dock walers 2 which are locked in place on either side of two dock float assemblies 3.

Figures 1, 2:
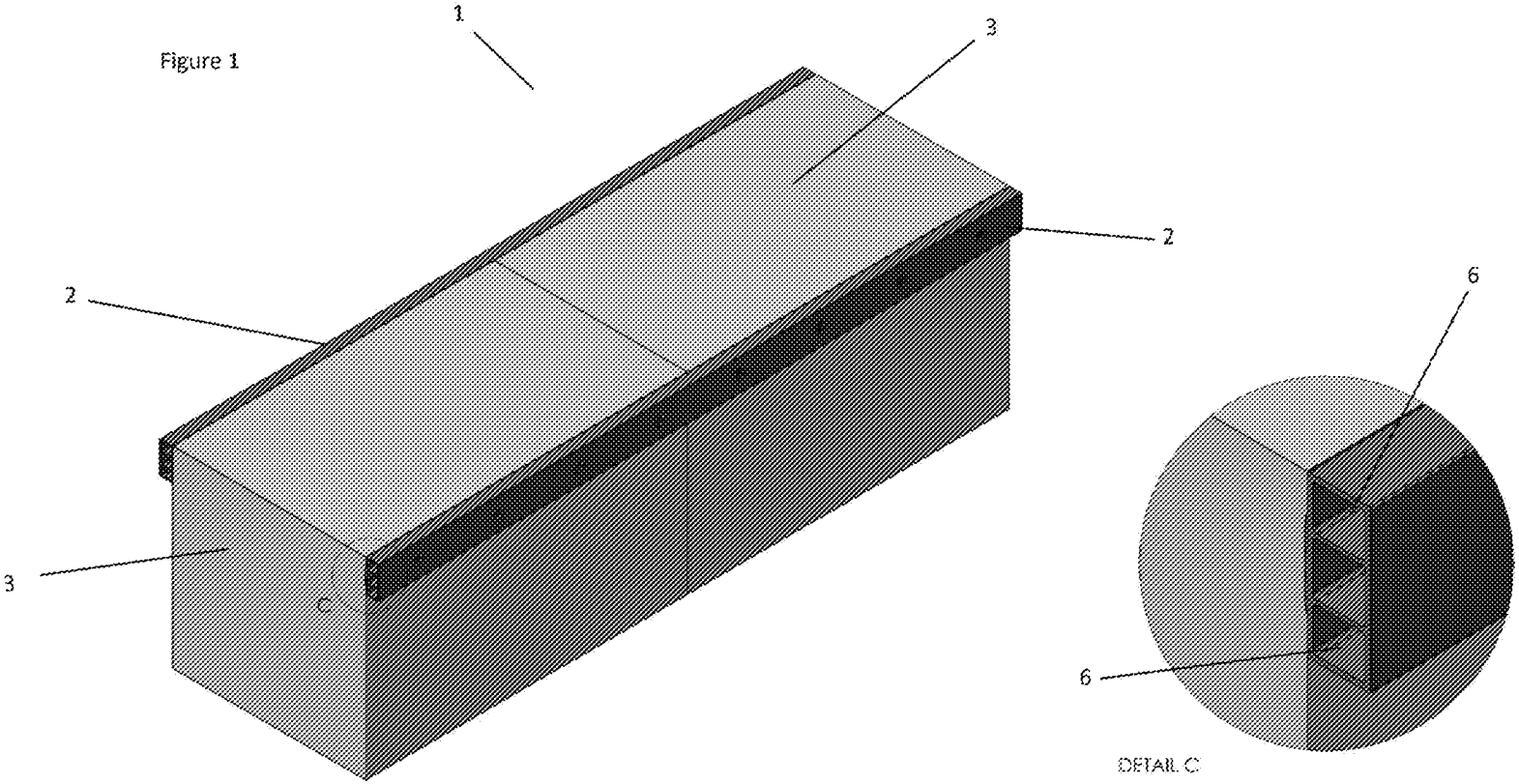
FIG. 1 shows a perspective view of a floating dock provided in accordance with a preferred embodiment of the invention.
FIG. 2 shows a detailed view of the front right corner region C of the floating dock of FIG. 1.
Figure 3:
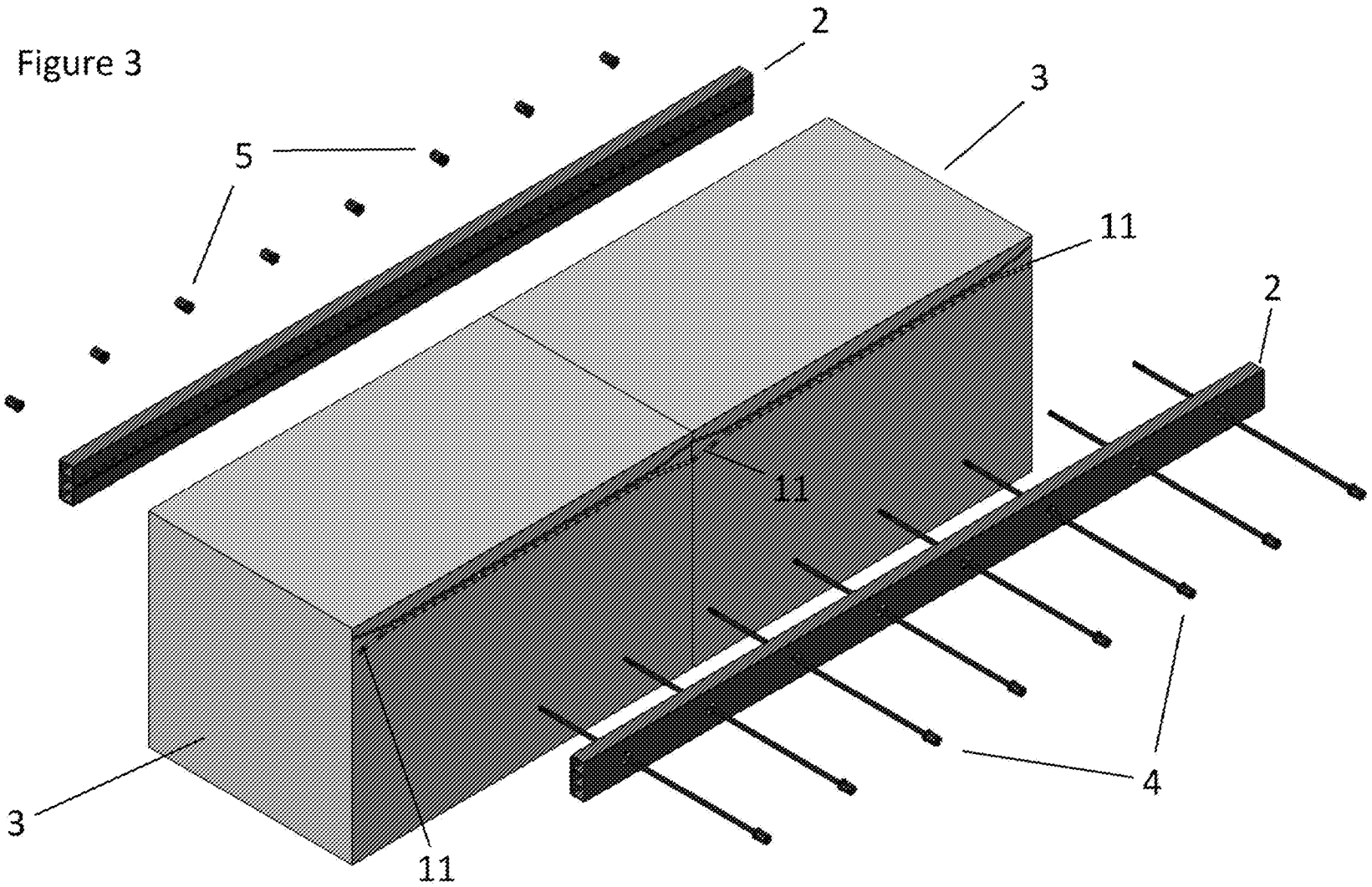
FIG. 3 shows an exploded view of the floating dock of FIG. 1.

The exploded view of FIG. 3 shows how an array of tie rods 4 are threaded through each waler 2 and the dock float assemblies 3 to lock these components together using tie rod nuts 5.

Each dock waler 2 is moulded from a settable material, in this embodiment being from plastic. The dock waler defines a main body which encloses a volume and defines a series of interior cavities. As can be seen from the enlargement view of FIG. 2 the main body of a waler defines two access ports 6 allowing service conduits to be run through the interior cavity of the main body.

Each dock waler defines an engagement structure 7 which is arranged to engage with a complimentary engagement structure 8 formed in the dock float assemblies. These engagement structures and their compliments are orientated along the longitudinal axis of the waler. The tie rods and nuts hold the engagement structures of a dock waler in contact with the complimentary engagement structures of the dock float assemblies.

Figure 4:
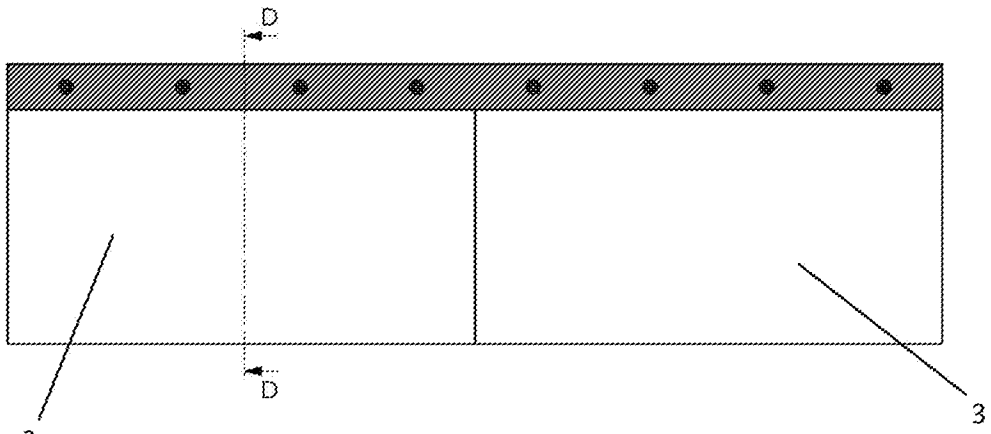
FIG. 4 shows a side view of the floating dock of FIG. 1.
Figure 5:
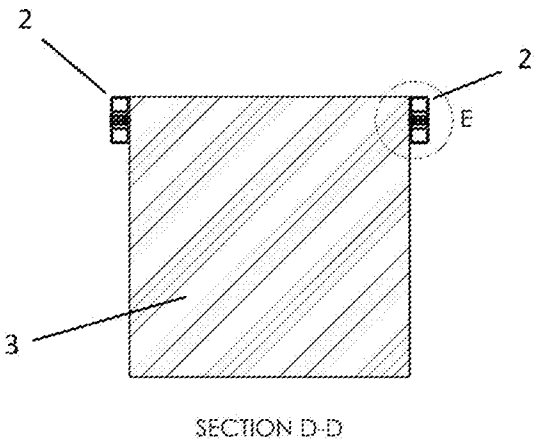
FIG. 5 shows a transverse cross section view of the floating dock of FIG. 1 through section D-D shown in FIG. 4.
Figure 6:
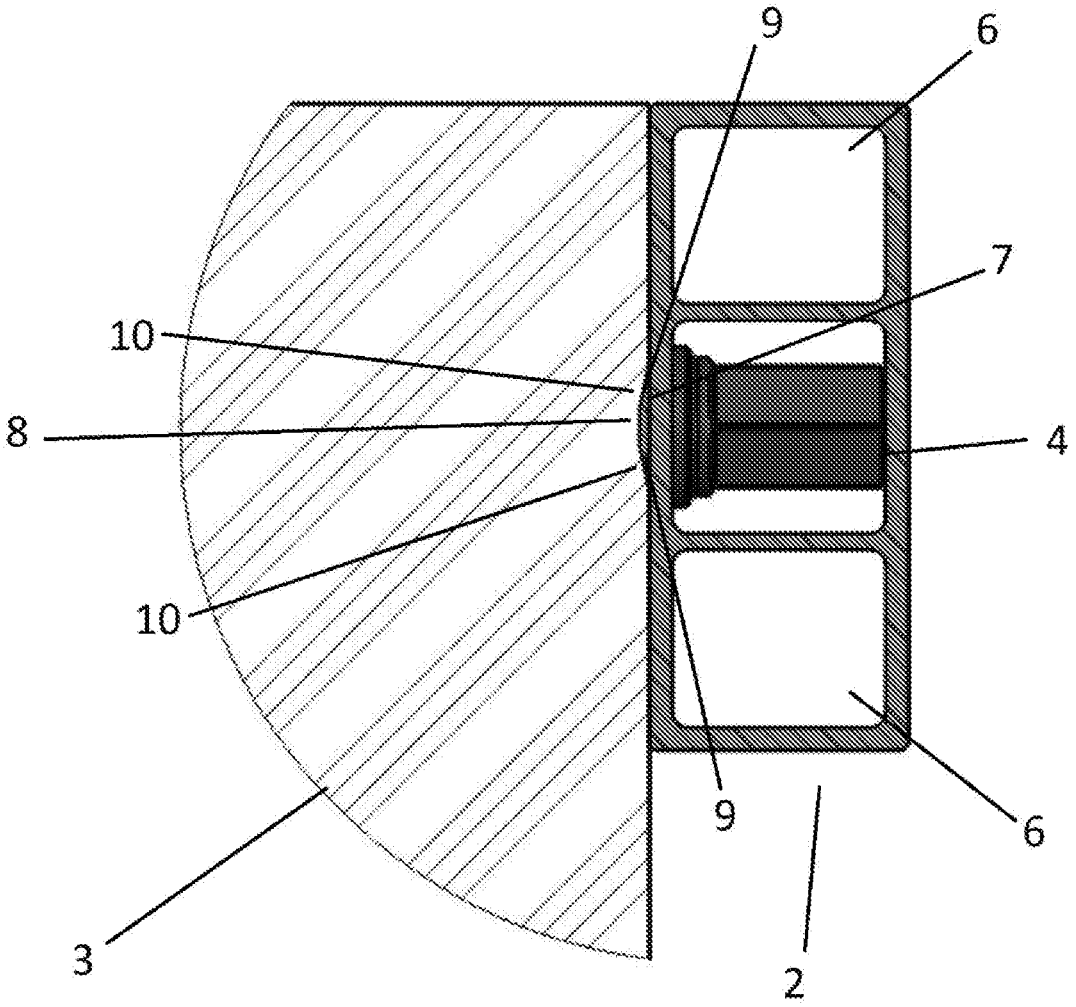
FIG. 6 shows a detailed view of region E of FIG. 5.

FIGS. 4, 5 and 6 show these engagement structures in more detail. In the embodiment shown the engagement structures are arranged to project into complimentary cavities formed in the sides of each dock float assembly.

Each engagement structure of a dock waler defines a pair of angled contact surfaces 9 which contact complimentary angled contact surfaces 10 formed in the complimentary engagement structure of the dock float assembly. These angled contact surfaces are orientated at an angle to a vertical plane when integrated into the resulting floating dock.

Figure 8:
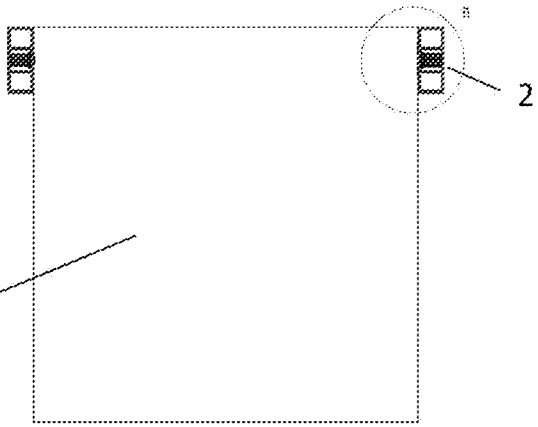
FIG. 8 shows a transverse cross section view of the floating dock of FIG. 1 at the intersection of the pair of dock float assemblies.
Figure 7:
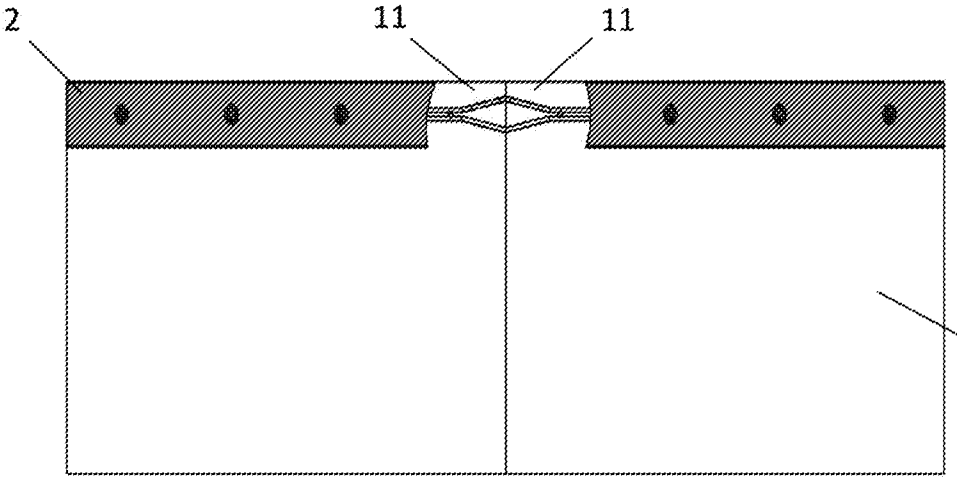
FIG. 7 shows a side view of the floating dock of FIG. 1 with portions of the dock waler removed.
Figure 9:
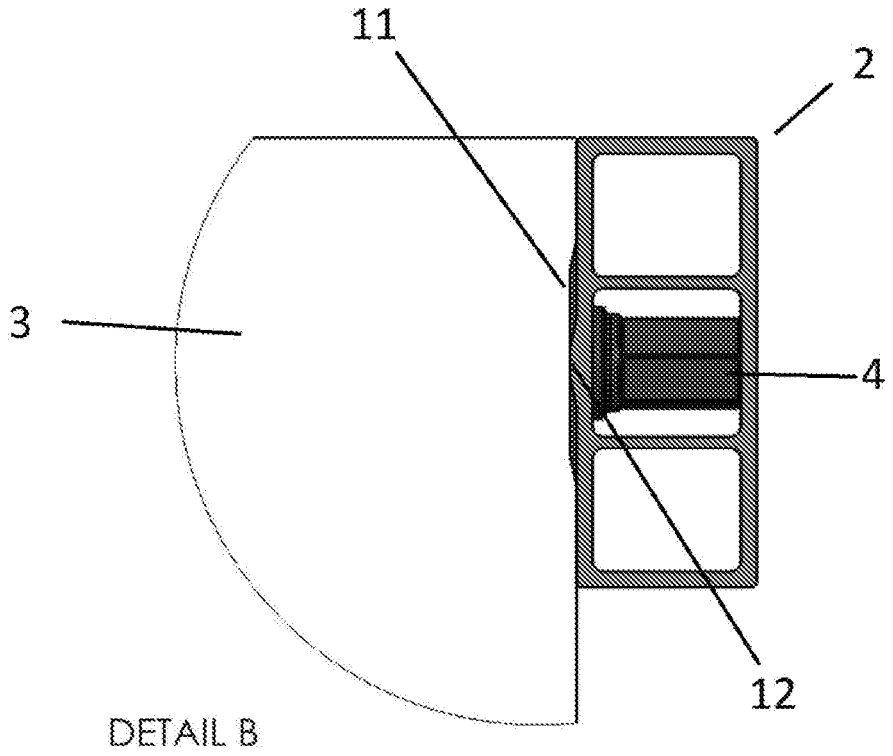
FIG. 9 shows a detailed view of region B of FIG. 8.

FIGS. 7, 8 and 9 show details of flex control structures 11 provided in each dock float assembly. In particular each dock float assembly defines a pair of flex control structure 11 at each of its longitudinal ends. These flex control structures contact a complimentary flex control structure 12 formed in a dock waler when the end or ends of the dock waler flex out of alignment with the longitudinal axis of the dock waler. In the embodiment shown the complimentary flex control structure of each dock waler is the same form as that used to provide the waler's engagement structures.

It is to be understood that the present invention is not limited to the embodiment described herein and further and additional embodiments within the spirit and scope of the invention will be apparent to the skilled reader from the examples illustrated with reference to the drawings. In particular, the invention may reside in any combination of features described herein, or may reside in alternative embodiments or combinations of these features with known equivalents to given features. Modifications and variations of the example embodiments of the invention discussed above will be apparent to those skilled in the art and may be made without departure of the scope of the invention as defined in the appended claims.

What I claim is:

1. A dock waler moulded from a settable material and configured to engage together a plurality of dock float assemblies, the dock waler defining a main body which encloses a volume and defines at least one interior cavity, the body defining at least one engagement structure arranged to interlock with a complimentary engagement structure formed in a dock float assembly vertically orientated side wall of a dock float assembly with a void in one engagement structure being filled by a projection provided by the other, where said at least one engagement structure of a dock waler defines at least one angled contact surface arranged to contact a complimentary angled contact surface formed in a complimentary engagement structure, said angled contact surfaces being orientated at an angle to a vertical plane when interlocked with a vertically orientated side wall of a dock float assembly, the volume enclosed by the main body being arranged to receive at least a portion of a tie rod configured to hold the engagement structure of a dock waler in contact with the complimentary engagement structure of a dock float assembly, wherein the engagement structure of a dock waler impedes vertical movement of the dock waler at least in the region where a tie rod extends from a dock float and into the interior volume of the dock water when said engagement structure is engaged with the complimentary engagement structure of a dock float and said at least one angled contact surface of the engagement structure translates vertical loads placed on the waler into horizontal tensioning forces applied to the tie rod.

2. A dock waler as claimed in claim 1 wherein the settable material is formed from or incorporates thermoplastics.

3. A dock waler as claimed in claim 1 wherein the settable material is formed from or incorporates fibre reinforced plastics.

4. A dock waler as claimed in claim 1 wherein the settable material is formed from or incorporates a thermosetting resin.

5. A dock waler as claimed in claim 1 wherein the settable material is formed from or incorporates a thermoplastic resin.

6. A dock wider as claimed in claim 1 wherein the main body defines at least two access ports which are configured to locate at least one service conduit run through the at least one interior cavity of the main body.

7. A dock waler as claimed in claim 6 wherein said at least one service conduit provides any one Or combination of member selected from the group consisting of: fresh water, hydrocarbon based fuels, electrical energy supply currents and/or form one or more communications cables.

8. A dock waler as claimed in claim 1 which incorporates one or more internal strengthening ribs which span said at least one interior cavity.

9. A dock waler as claimed in claim 1 wherein an engagement structure is formed from a triangular projection which is received by a matching slot defined in a complimentary engagement structure.

10. A dock waler as claimed in claim 1 wherein the dock waler defines a flex control structure at a longitudinal end of the dock waler, said flex control structure being arranged to contact a complimentary flex control structure formed in a dock float assembly when the end or ends of the dock waler flex out of alignment with the longitudinal axis of the dock waler.

11. A dock waler as claimed in claim 10 which defines a flex control structure at each longitudinal end of the dock waler.

12. A dock waler as claimed in claim 10 wherein a flex control structure is defined by a projection which tapers in height as it as it extends towards the end of the waler.

13. A dock waler as claimed in claim 10 wherein a flex control structure is defined by a recess in the main body of the waler which flares in height as it as it extends towards the end of the waler.

14. A dock waler as claimed in claim 10 wherein a radius of curvature defined in the form of the flex control structures control the degree of allowable flex of ends of the waler.

15. A floating dock which includes at least one dock waler as claimed in claim 1, and at least two of the dock float assemblies each defining a complimentary engagement structure, the plurality of dock float assemblies being engaged together by the engagement structure of a dock waler contacting the complimentary engagement structures of the dock float assemblies, at least one tie rod connected to each dock float assembly and extending in to a dock waler, said tie rods being configured to hold the engagement structure of a dock waler in contact with the complimentary engagement structure of a dock float assembly, wherein the engagement structure of a dock waler impedes vertical movement of the dock waler at least in the region where a tie rod extends from a dock float and into the interior volume of the dock waler when said engagement structure is engaged with the complimentary engagement structure of a dock float and said at least one angled contact surface of die engagement structure translates vertical loads placed on the waler into horizontal tensioning forces applied to the tie rod.

16. A floating dock as claimed in claim 15 wherein an engagement structure and its compliment are connected together by a laterally sliding the dock waler along the perimeter side of a float assembly.

17. A floating dock as claimed in claim 15 wherein a dock float assembly forms a complimentary flex control structure which defines a projection which tapers in height as it extends towards the end of the dock float assembly.

18. A floating dock as claimed in claim 15 wherein a dock float assembly forms a complimentary flex control structure which defines a recess which flares in height as it extends towards the end of the dock float assembly.

* * * * *